US009363596B2

(12) United States Patent
Dusan et al.

(10) Patent No.: US 9,363,596 B2
(45) Date of Patent: Jun. 7, 2016

(54) SYSTEM AND METHOD OF MIXING ACCELEROMETER AND MICROPHONE SIGNALS TO IMPROVE VOICE QUALITY IN A MOBILE DEVICE

(71) Applicant: Apple Inc., Cupertino, CA (US)

(72) Inventors: Sorin V. Dusan, San Jose, CA (US); Aram Lindahl, Menlo Park, CA (US); Esge B. Andersen, Campbell, CA (US)

(73) Assignee: Apple Inc., Cupertino, CA (US)

( * ) Notice: Subject to any disclaimer, the term of this patent is extended or adjusted under 35 U.S.C. 154(b) by 278 days.

(21) Appl. No.: 13/840,667

(22) Filed: Mar. 15, 2013

(65) Prior Publication Data

US 2014/0270231 A1 Sep. 18, 2014

(51) Int. Cl.
*G10L 21/0232* (2013.01)
*H04R 1/46* (2006.01)
(Continued)

(52) U.S. Cl.
CPC ..... *H04R 1/46* (2013.01); *G10L 21/0216* (2013.01); *G10L 25/90* (2013.01); *H04R 3/005* (2013.01); *G10L 2021/02166* (2013.01); *G10L 2021/02168* (2013.01); *H04R 1/1033* (2013.01); *H04R 1/1041* (2013.01); *H04R 1/1083* (2013.01); *H04R 2201/107* (2013.01); *H04R 2460/13* (2013.01)

(58) Field of Classification Search
CPC . G10L 21/0232; G10L 25/90; G10L 21/0216; G10L 2201/02166; G10L 2201/02168; H04R 1/10; H04R 1/1041; H04R 1/46; H04R 3/005; H04R 1/1033; H04R 1/1083; H04R 1/1016; H04R 1/406; H04R 2201/403; H04R 2201/107; H04R 2410/01; H04R 2410/05; H04R 2460/13
USPC ..... 381/74, 92, 110
See application file for complete search history.

(56) References Cited

U.S. PATENT DOCUMENTS 5,692,059 A 11/1997 Kruger
6,006,175 A 12/1999 Holzrichter
(Continued)

OTHER PUBLICATIONS

Rahman, Shahidur M et al., "Low-Frequency Band Noise Suppression Using Bone Conducted Speech", Communications, Computers and Signal Processing (PACRIM, 2011 IEEE Pacific Rim Conference on, IEEE, Aug. 23, 2011, pp. 520-525.
(Continued)

*Primary Examiner* — Harry S Hong
(74) *Attorney, Agent, or Firm* — Blakely, Sokoloff, Taylor & Zafman LLP

(57) ABSTRACT

A method of improving voice quality in a mobile device starts by receiving acoustic signals from microphones included in earbuds and the microphone array included on a headset wire. The headset may include the pair of earbuds and the headset wire. An output from an accelerometer that is included in the pair of earbuds is then received. The accelerometer may detect vibration of the user's vocal chords filtered by the vocal tract based on vibrations in bones and tissue of the user's head. A spectral mixer included in the mobile device may then perform spectral mixing of the scaled output from the accelerometer with the acoustic signals from the microphone array to generate a mixed signal. Performing spectral mixing includes scaling the output from the inertial sensor by a scaling factor based on a power ratio between the acoustic signals from the microphone array and the output from the inertial sensor. Other embodiments are also described.

28 Claims, 10 Drawing Sheets

(51) Int. Cl.

| | |
|---|---|
| ***G10L 25/90*** | (2013.01) |
| ***H04R 1/10*** | (2006.01) |
| ***G10L 21/0216*** | (2013.01) |
| ***H04R 3/00*** | (2006.01) |

(56) References Cited

U.S. PATENT DOCUMENTS

| | | | | |
|---|---|---|---|---|
| 7,499,686 | B2 | 3/2009 | Sinclair et al. | |
| 7,983,907 | B2 | 7/2011 | Visser et al. | |
| 8,019,091 | B2 | 9/2011 | Burnett et al. | |
| 2003/0179888 | A1 | 9/2003 | Burnett et al. | |
| 2011/0010172 | A1 | 1/2011 | Konchitsky | |
| 2011/0135120 | A1 | 6/2011 | Larsen et al. | |
| 2011/0208520 | A1 | 8/2011 | Lee | |
| 2011/0222701 | A1 | 9/2011 | Donaldson et al. | |
| 2012/0215519 | A1 | 8/2012 | Park et al. | |
| 2012/0230507 | A1* | 9/2012 | DeLuca | H04R 1/1041 381/74 |
| 2012/0259628 | A1 | 10/2012 | Siotis | |
| 2012/0263322 | A1* | 10/2012 | Lovitt | 381/119 |
| 2012/0316869 | A1 | 12/2012 | Xiang et al. | |
| 2014/0093091 | A1* | 4/2014 | Dusan et al. | 381/74 |
| 2014/0093093 | A1* | 4/2014 | Dusan et al. | 381/74 |

OTHER PUBLICATIONS

Dusan, Sorin et al., "Speech Compression by Polynomial Approximation", IEEE Transactions on Audio, Speech, and Language Processing, vol. 15, No. 2, Feb. 2007, 1558-7916, pp. 387-395.

Dusan, Sorin et al., "Speech Coding Using trajectory Compression and Multiple Sensors", Center for Advanced Information Processing (CAIP), Rutgers University, Piscataway, NJ, USA, 4 pages.

Hu, Rongqiang; "Multi-Sensor Noise Suppression and Bandwidth Extension for Enhancement of Speech", A Dissertation Presented to The Academic Faculty, School of Electrical and Computer Engineering Institute of Technology, May 2006, pp. xi-xiii & 1-3.

* cited by examiner

SYSTEM AND METHOD OF MIXING ACCELEROMETER AND MICROPHONE SIGNALS TO IMPROVE VOICE QUALITY IN A MOBILE DEVICE

FIELD

Embodiments of the invention relate generally to a system and method of improving the speech quality in a mobile device by using a voice activity detector (VAD) output to perform spectral mixing of signals from an accelerometer included in the earbuds of a headset with acoustic signals from a microphone array included in the headset and by using the pitch estimate generated based on the signals from the accelerometer.

BACKGROUND

Currently, a number of consumer electronic devices are adapted to receive speech via microphone ports or headsets. While the typical example is a portable telecommunications device (mobile telephone), with the advent of Voice over IP (VoIP), desktop computers, laptop computers and tablet computers may also be used to perform voice communications.

When using these electronic devices, the user also has the option of using the speakerphone mode or a wired headset to receive his speech. However, a common complaint with these hands-free modes of operation is that the speech captured by the microphone port or the headset includes environmental noise such as wind noise, secondary speakers in the background or other background noises. This environmental noise often renders the user's speech unintelligible and thus, degrades the quality of the voice communication.

SUMMARY

Generally, the invention relates to improving the voice sound quality in electronic devices by using signals from an accelerometer included in an earbud of an enhanced headset for use with the electronic devices. Specifically, the invention discloses performing spectral mixing of the signals from the accelerometer with acoustic signals from microphones and generating a pitch estimate using the signals from the accelerometer.

In one embodiment of the invention, a method of improving voice quality in a mobile device starts with the mobile device by receiving acoustic signals from microphones included in a pair of earbuds and the microphone array included on a headset wire. The headset may include the pair of earbuds and the headset wire. The mobile device then receives an output from an inertial sensor that is included in the pair of earbuds. The inertial sensor may detect vibration of the user's vocal chords based on vibrations in bones and tissue of the user's head. In some embodiments, the inertial sensor is an accelerometer that is included in each of the earbuds. A spectral mixer included in the mobile device may then perform spectral mixing of the output from the inertial sensor with the acoustic signals from the microphone array to generate a mixed signal. Performing spectral mixing may include scaling the output from the inertial sensor by a scaling factor based on a power ratio between the acoustic signals from the microphone array and the output from the inertial sensor.

In another embodiment of the invention, a system for improving voice quality in a mobile device comprises a headset including a pair of earbuds and a headset wire and a spectral mixer coupled to the headset. Each of the earbuds may include earbud microphones and an accelerometer to detect vibration of the user's vocal chords based on vibrations in bones and tissues of the user's head. The headset wire may include a microphone array. The spectral mixer may perform spectral mixing of the output from the accelerometer with the acoustic signals from the microphone array to generate a mixed signal. Performing spectral mixing may include scaling the output from the inertial sensor by a scaling factor based on a power ratio between the acoustic signals from the microphone array and the output from the inertial sensor.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 1:
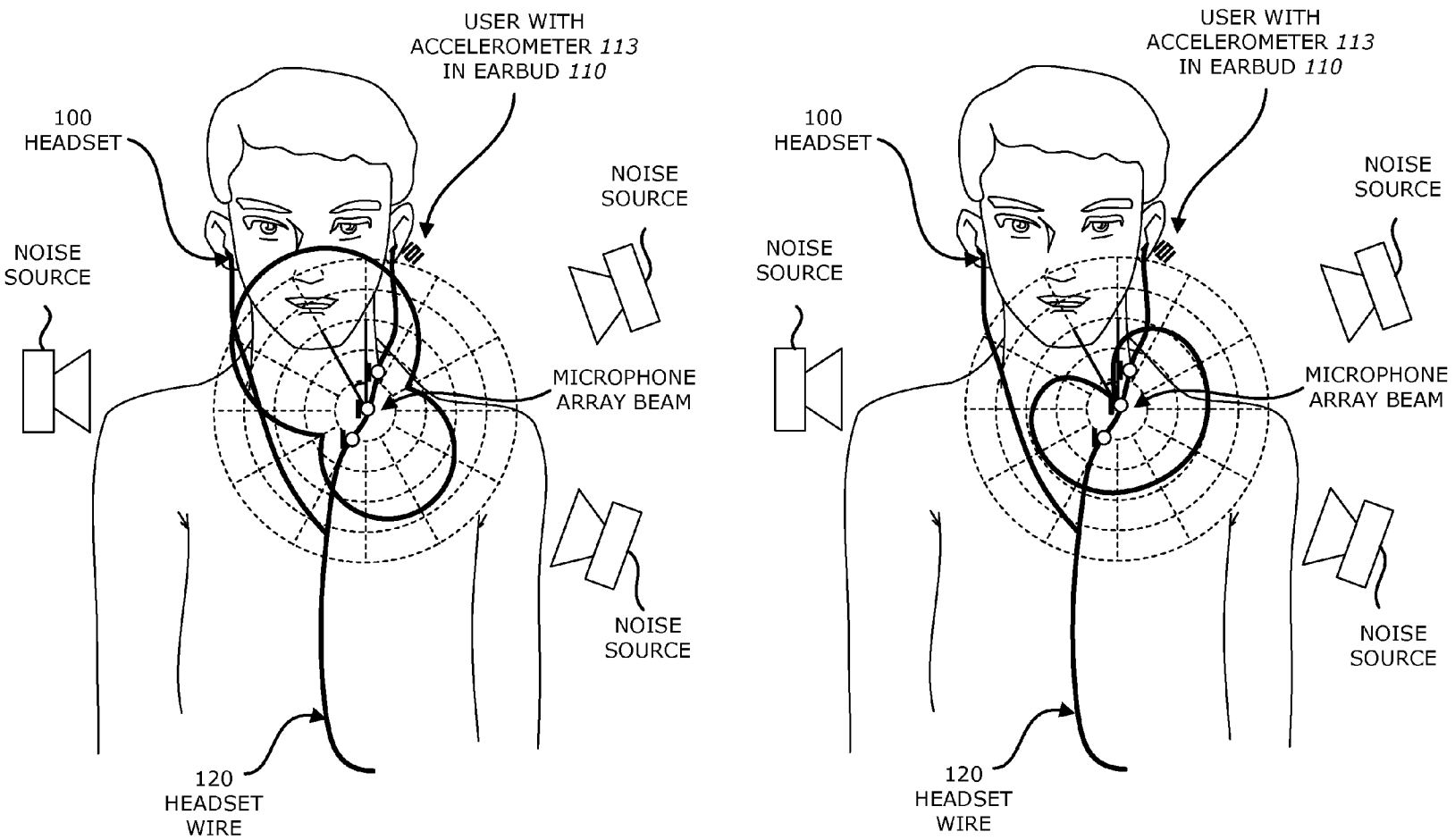
FIG. 1 illustrates an example of the headset in use according to one embodiment of the invention.
Figure 2:
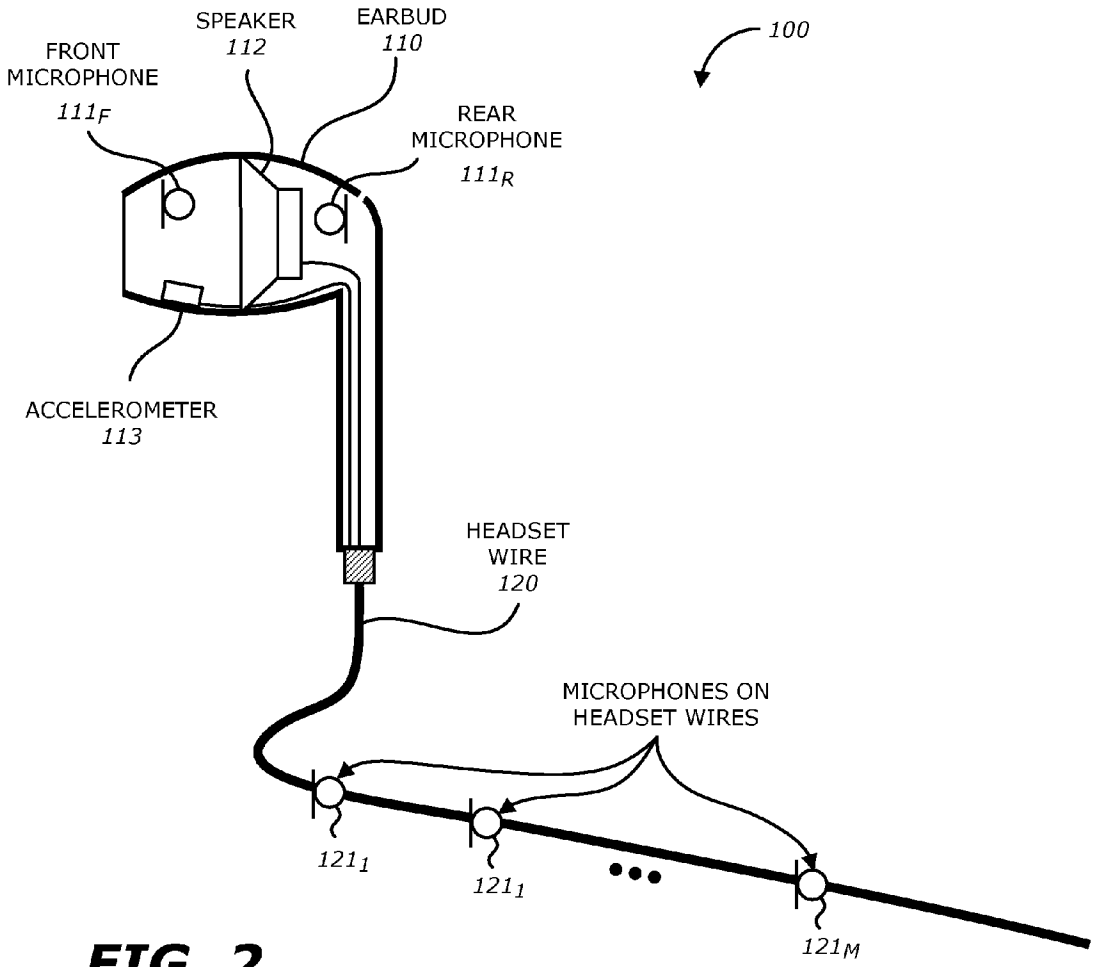
FIG. 2 illustrates an example of the right side of the headset used with a consumer electronic device in which an embodiment of the invention may be implemented.

FIG. 1 illustrates an example of a headset in use that may be coupled with a consumer electronic device according to one embodiment of the invention. As shown in FIGS. 1 and 2, the headset 100 includes a pair of earbuds 110 and a headset wire 120. The user may place one or both the earbuds 110 into his ears and the microphones in the headset may receive his speech. The microphones may be air interface sound pickup devices that convert sound into an electrical signal. The headset 100 in FIG. 1 is double-earpiece headset. It is understood that single-earpiece or monaural headsets may also be used. As the user is using the headset to transmit his speech, environmental noise may also be present (e.g., noise sources in FIG. 1). While the headset 100 in FIG. 2 is an in-ear type of headset that includes a pair of earbuds 110 which are placed inside the user's ears, respectively, it is understood that headsets that include a pair of earcups that are placed over the user's ears may also be used. Additionally, embodiments of the invention may also use other types of headsets.

FIG. 2 illustrates an example of the right side of the headset used with a consumer electronic device in which an embodiment of the invention may be implemented. It is understood that a similar configuration may be included in the left side of the headset 100.

As shown in FIG. 2, the earbud 110 includes a speaker 112, a sensor detecting movement such as an accelerometer 113, a front microphone $\mathbf{111}_F$ that faces the direction of the eardrum and a rear microphone $\mathbf{111}_R$ that faces the opposite direction of the eardrum. The earbud 110 is coupled to the headset wire 120, which may include a plurality of microphones $\mathbf{121}_1$-$\mathbf{121}_M$ (M>1) distributed along the headset wire that can form one or more microphone arrays. As shown in FIG. 1, the microphone arrays in the headset wire 120 may be used to create microphone array beams (i.e., beamformers) which can be steered to a given direction by emphasizing and deemphasizing selected microphones $\mathbf{121}_1$-$\mathbf{121}_M$. Similarly, the microphone arrays can also exhibit or provide nulls in other given directions. Accordingly, the beamforming process, also referred to as spatial filtering, may be a signal processing technique using the microphone array for directional sound reception. The headset 100 may also include one or more integrated circuits and a jack to connect the headset 100 to the electronic device (not shown) using digital signals, which may be sampled and quantized.

When the user speaks, his speech signals may include voiced speech and unvoiced speech. Voiced speech is speech that is generated with excitation or vibration of the user's vocal chords. In contrast, unvoiced speech is speech that is generated without excitation of the user's vocal chords. For example, unvoiced speech sounds include /s/, /sh/, /f/, etc. Accordingly, in some embodiments, both the types of speech (voiced and unvoiced) are detected in order to generate an augmented voice activity detector (VAD) output which more faithfully represents the user's speech.

First, in order to detect the user's voiced speech, in one embodiment of the invention, the output data signal from accelerometer 113 placed in each earbud 110 together with the signals from the front microphone $\mathbf{111}_F$, the rear microphone $\mathbf{111}_R$, the microphone array $\mathbf{121}_1$-$\mathbf{121}_M$ or the beamformer may be used. The accelerometer 113 may be a sensing device that measures proper acceleration in three directions, X, Y, and Z or in only one or two directions. When the user is generating voiced speech, the vibrations of the user's vocal chords are filtered by the vocal tract and cause vibrations in the bones of the user's head which are detected by the accelerometer 113 in the headset 110. In other embodiments, an inertial sensor, a force sensor or a position, orientation and movement sensor may be used in lieu of the accelerometer 113 in the headset 110.

In the embodiment with the accelerometer 113, the accelerometer 113 is used to detect the low frequencies since the low frequencies include the user's voiced speech signals. For example, the accelerometer 113 may be tuned such that it is sensitive to the frequency band range that is below 2000 Hz. In one embodiment, the signals below 60 Hz-70 Hz may be filtered out using a high-pass filter and above 2000 Hz-3000 Hz may be filtered out using a low-pass filter. In one embodiment, the sampling rate of the accelerometer may be 2000 Hz but in other embodiments, the sampling rate may be between 2000 Hz and 6000 Hz. In another embodiment, the accelerometer 113 may be tuned to a frequency band range under 1000 Hz. It is understood that the dynamic range may be optimized to provide more resolution within a forced range that is expected to be produced by the bone conduction effect in the headset 100. Based on the outputs of the accelerometer 113, an accelerometer-based VAD output (VADa) may be generated, which indicates whether or not the accelerometer 113 detected speech generated by the vibrations of the vocal chords. In one embodiment, the power or energy level of the outputs of the accelerometer 113 is assessed to determine whether the vibration of the vocal chords is detected. The power may be compared to a threshold level that indicates the vibrations are found in the outputs of the accelerometer 113. In another embodiment, the VADa signal indicating voiced speech is computed using the normalized cross-correlation between any pair of the accelerometer signals (e.g. X and Y, X and Z, or Y and Z). If the cross-correlation has values exceeding a threshold within a short delay interval the VADa indicates that the voiced speech is detected. In some embodiments, the VADa is a binary output that is generated as a voice activity detector (VAD), wherein 1 indicates that the vibrations of the vocal chords have been detected and 0 indicates that no vibrations of the vocal chords have been detected.

Using at least one of the microphones in the headset 110 (e.g., one of the microphones in the microphone array $\mathbf{121}_1$-$\mathbf{121}_M$, front earbud microphone $\mathbf{111}_F$, or back earbud microphone $\mathbf{111}_R$) or the output of a beamformer, a microphone-based VAD output (VADm) may be generated by the VAD to indicate whether or not speech is detected. This determination may be based on an analysis of the power or energy present in the acoustic signal received by the microphone. The power in the acoustic signal may be compared to a threshold that indicates that speech is present. In another embodiment, the VADm signal indicating speech is computed using the normalized cross-correlation between any pair of the microphone signals (e.g. $\mathbf{121}_1$ and $\mathbf{121}_M$). If the cross-correlation has values exceeding a threshold within a short delay interval the VADm indicates that the speech is detected. In some embodiments, the VADm is a binary output that is generated as a voice activity detector (VAD), wherein 1 indicates that the speech has been detected in the acoustic signals and 0 indicates that no speech has been detected in the acoustic signals.

Both the VADa and the VADm may be subject to erroneous detections of voiced speech. For instance, the VADa may falsely identify the movement of the user or the headset 100 as being vibrations of the vocal chords while the VADm may falsely identify noises in the environment as being speech in the acoustic signals. Accordingly, in one embodiment, the VAD output (VADv) is set to indicate that the user's voiced speech is detected (e.g., VADv output is set to 1) if the coincidence between the detected speech in acoustic signals (e.g., VADm) and the user's speech vibrations from the accelerometer output data signals is detected (e.g., VADa). Conversely, the VAD output is set to indicate that the user's voiced speech is not detected (e.g., VADv output is set to 0) if this coincidence is not detected. In other words, the VADv output is obtained by applying an AND function to the VADa and VADm outputs.

The VAD output may be used in a number of ways. For instance, in one embodiment, a noise suppressor may estimate the user's speech when the VAD output is set to 1 and may estimate the environmental noise when the VAD output is set to 0. In another embodiment, when the VAD output is set to 1, one microphone array may detect the direction of the user's mouth and steer a beamformer in the direction of the user's mouth to capture the user's speech while another microphone array may steer a cardioid or other beamforming patterns in the opposite direction of the user's mouth to capture the environmental noise with as little contamination of the user's speech as possible. In this embodiment, when the VAD output is set to 0, one or more microphone arrays may detect the direction and steer a second beamformer in the direction of the main noise source or in the direction of the individual noise sources from the environment.

The latter embodiment is illustrated in FIG. 1, the user in the left part of FIG. 1 is speaking while the user in the right part of FIG. 1 is not speaking. When the VAD output is set to 1, at least one of the microphone arrays is enabled to detect the direction of the user's mouth. The same or another microphone array creates a beamforming pattern in the direction of the user's mouth, which is used to capture the user's speech. Accordingly, the beamformer outputs an enhanced speech signal. When the VAD output is 0, the same or another microphone array may create a cardioid beamforming pattern or other beamforming patterns in the direction opposite to the user's mouth, which is used to capture the environmental noise. When the VAD output is 0, other microphone arrays may create beamforming patterns (not shown in FIG. 1) in the directions of individual environmental noise sources. When the VAD output is 0, the microphone arrays is not enabled to detect the direction of the user's mouth, but rather the beamformer is maintained at its previous setting. In this manner, the VAD output is used to detect and track both the user's speech and the environmental noise.

The microphone arrays are generating beams in the direction of the mouth of the user in the left part of FIG. 1 to capture the user's speech (voice beam) and in the direction opposite to the direction of the user's mouth in the right part of FIG. 1 to capture the environmental noise (noise beam).

While the beamformers described above are able to help capture the sounds from the user's mouth and remove the environmental noise, when the power of the environmental noise is above a given threshold or when wind noise is detected in at least two microphones, the acoustic signals captured by the beamformers may not be adequate. Accordingly, in one embodiment of the invention, rather than only using the acoustic signals captured by the beamformers, the system performs spectral mixing of the accelerometer's 113 output signals and the acoustic signals received from microphone array $\mathbf{121}_1$-$\mathbf{121}_M$ or beamformer to generate a mixed signal. In one embodiment, the accelerometer's 113 output signals account for the low frequency band (e.g., 1000 Hz and under) of the mixed signal and the acoustic signal received from the microphone array $\mathbf{121}_1$-$\mathbf{121}_M$ accounts for the high frequency band (e.g., over 1000 Hz). In another embodiment, the system performs spectral mixing of the accelerometer's 113 output signals with the acoustic signals captured by the beamformers to generate a mixed signal.

Figure 3:
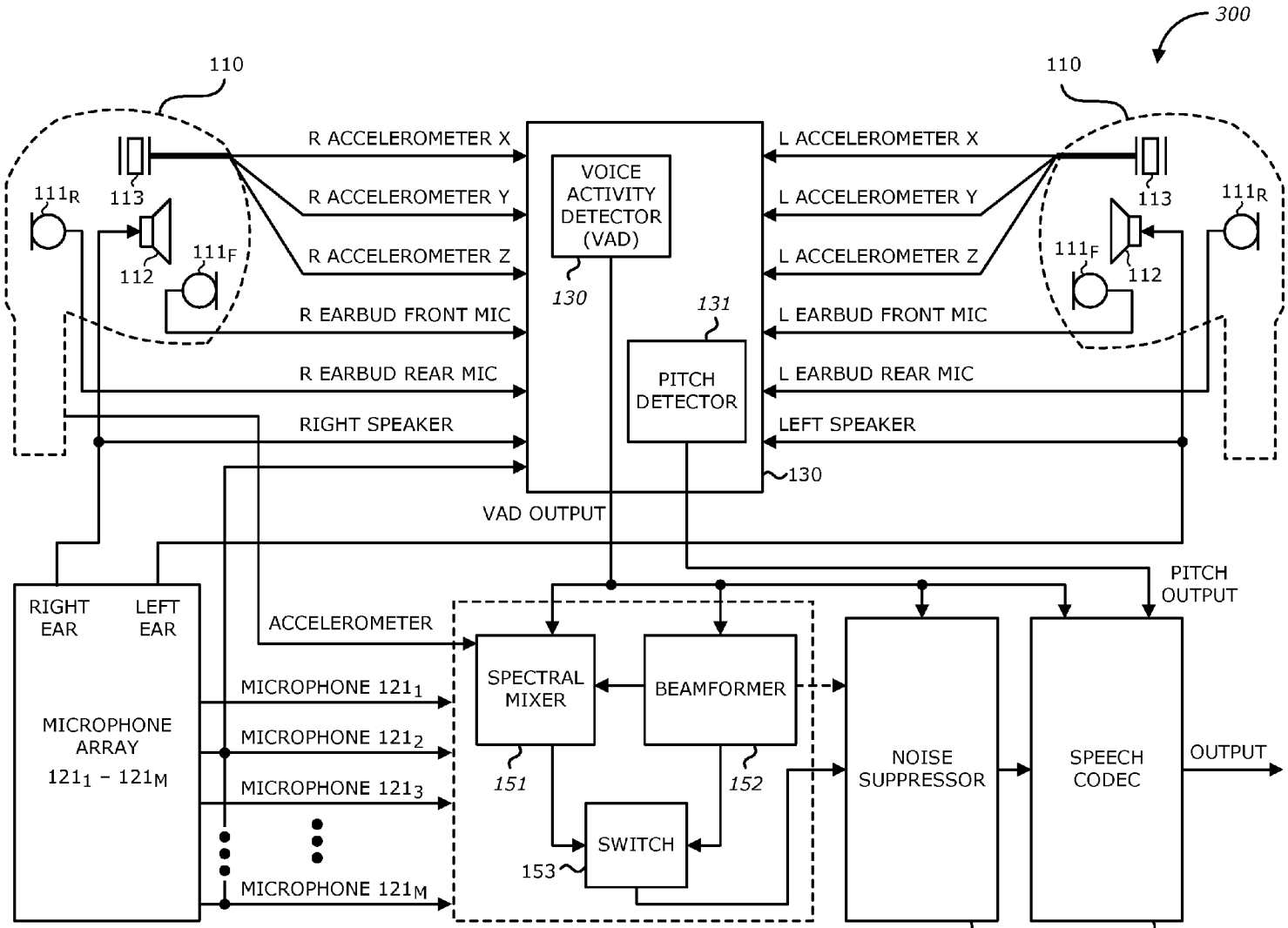
FIG. 3 illustrates a block diagram of a system for improving voice quality in a mobile device according to an embodiment of the invention.

FIG. 3 illustrates a block diagram of a system for improving voice quality in a mobile device according to an embodiment of the invention. The system 300 in FIG. 3 includes the headset having the pair of earbuds 110 and the headset wire and an electronic device that includes a VAD 130, a pitch detector 131, a spectral mixer 151, a beamformer 152, a switch 153, a noise suppressor 140, and a speech codec 160. As shown in FIG. 3, the VAD 130 receives the accelerometer's 113 output signals that provide information on sensed vibrations in the x, y, and z directions and the acoustic signals received from the microphones $\mathbf{111}_F$, $\mathbf{111}_R$ and microphone array $\mathbf{121}_1$-$\mathbf{121}_M$. It is understood that a plurality of microphone arrays (beamformers) on the headset wire 120 may also provide acoustic signals to the VAD 130, and the spectral mixer 151.

The accelerometer signals may be first pre-conditioned. First, the accelerometer signals are pre-conditioned by removing the DC component and the low frequency components by applying a high pass filter with a cut-off frequency of 60 Hz-70 Hz, for example. Second, the stationary noise is removed from the accelerometer signals by applying a spectral subtraction method for noise suppression. Third, the cross-talk or echo introduced in the accelerometer signals by the speakers in the earbuds may also be removed. This cross-talk or echo suppression can employ any known methods for echo cancellation. Once the accelerometer signals are pre-conditioned, the VAD 130 may use these signals to generate the VAD output. In one embodiment, the VAD output is generated by using one of the X, Y, and Z accelerometer signals which shows the highest sensitivity to the user's speech or by adding the three accelerometer signals and computing the power envelope for the resulting signal. When the power envelope is above a given threshold, the VAD output is set to 1, otherwise is set to 0. In another embodiment, the VAD signal indicating voiced speech is computed using the normalized cross-correlation between any pair of the accelerometer signals (e.g. X and Y, X and Z, or Y and Z). If the cross-correlation has values exceeding a threshold within a short delay interval the VAD indicates that the voiced speech is detected. In another embodiment, the VAD output is generated by computing the coincidence as a "AND" function between the VADm from one of the microphone signals or beamformer output and the VADa from one or more of the accelerometer signals (VADa). This coincidence between the VADm from the microphones and the VADa from the accelerometer signals ensures that the VAD is set to 1 only when both signals display significant correlated energy, such as the case when the user is speaking. In another embodiment, when at least one of the accelerometer signal (e.g., X, Y, or Z signals) indicates that user's speech is detected and is greater than a required threshold and the acoustic signals received from the microphones also indicates that user's speech is detected and is also greater than the required threshold, the VAD output is set to 1, otherwise is set to 0.

As shown in FIG. 3, the pitch detector 131 may receive the accelerometer's 113 output signals and generate a pitch estimate based on the output signals from the accelerometer. In one embodiment, the pitch detector 131 generates the pitch estimate by using one of the X signal, Y signal, or Z signal generated by the accelerometer that has a highest power level. In this embodiment, the pitch detector 131 may receive from the accelerometer 113 an output signal for each of the three axes (i.e., X, Y, and Z) of the accelerometer 113. The pitch detector 131 may determine a total power in each of the x, y, z signals generated by the accelerometer, respectively, and select the X, Y, or Z signal having the highest power to be used to generate the pitch estimate. In another embodiment, the pitch detector 131 generates the pitch estimate by using a combination of the X, Y, and Z signals generated by the accelerometer. The pitch may be computed by using the autocorrelation method or other pitch detection methods.

For instance, the pitch detector 131 may compute an average of the X, Y, and Z signals and use this combined signal to generate the pitch estimate. Alternatively, the pitch detector 131 may compute using cross-correlation a delay between the X and Y signals, a delay between the X and Z signals, and a delay between the Y and Z signals, and determine a most advanced signal from the X, Y, and Z signals based on the computed delays. For example, if the X signal is determined to be the most advanced signal, the pitch detector 131 may delay the remaining two signals (e.g., Y and Z signals). The pitch detector 131 may then compute an average of the most advanced signal (e.g., X signal) and the delayed remaining two signals (Y and Z signals) and use this combined signal to generate the pitch estimate. The pitch may be computed by using the autocorrelation method or other pitch detection methods. As shown in FIG. 3, the pitch estimate is outputted from the pitch detector 131 to the speech codec 160.

In one embodiment, the spectral mixer 151 and the beamformer 152 receive the acoustic signals from the microphone array $\mathbf{121}_1$-$\mathbf{121}_M$ as illustrated in FIG. 3. As discussed above, the beamformer 152 may be directed or steered to the direction of the user's mouth to provide an enhanced speech signal. In some embodiments, the spectral mixer 151 receives the enhanced speech signal from the beamformer 152 in lieu of the acoustic signals from the microphone array $\mathbf{121}_1$-$\mathbf{121}_M$.

As shown in FIG. 3, the spectral mixer 151 also receives the accelerometer's 113 output signals (e.g., X, Y, and Z signals). The spectral mixer 151 performs spectral mixing of the accelerometer's 113 output signals (e.g., X, Y, and Z signals) with the acoustic signals received from the microphone array $\mathbf{121}_1$-$\mathbf{121}_M$ to generate a mixed signal. In some embodiments, the spectral mixer 151 performs spectral mixing of the accelerometer's 113 output signals (e.g., X, Y, and Z signals) with the enhanced speech signal from the beamformer 152 to generate the mixed signal. The mixed signal includes the accelerometer's 113 output signals pre-emphasized and multiplied by a scaling factor as the low frequency band (e.g., 1000 Hz and under) and the acoustic signal received from the microphone array $\mathbf{121}_1$-$\mathbf{121}_M$ or from the beamformer as the high frequency band (e.g., over 1000 Hz).

In some embodiments, similar to the pitch detector 131, the spectral mixer 151 may use one of the signals (e.g., X, Y, and Z signals) from the accelerometer 113 or a combination of the signals from the accelerometer 113 to be spectrally mixed. In this embodiment, the spectral mixer 151 may receive from the accelerometer 113 an output signal for each of the three axes (i.e., X, Y, and Z) of the accelerometer 113. The spectral mixer 151 may determine a total power in each of the x, y, z signals generated by the accelerometer, respectively, and select the X, Y, or Z signal having the highest power to be used as the signal from the accelerometer 113 to be spectrally mixed with the acoustic signals from the microphone array $\mathbf{121}_1$-$\mathbf{121}_M$. In another embodiment, the spectral mixer 151 may compute an average of the X, Y, and Z signals to generate the signal from the accelerometer 113 to be spectrally mixed after pre-emphasis and multiplication with a scaling factor. Alternatively, the spectral mixer 151 may compute using cross-correlation a delay between the X and Y signals, a delay between the X and Z signals, and a delay between the Y and Z signals, and determine a most advanced signal from the X, Y, and Z signals based on the computed delays. For example, if the X signal is determined to be the most advanced signal, the spectral mixer 151 may delay the remaining two signals (e.g., Y and Z signals). The spectral mixer 151 may then compute an average of the most advanced signal (e.g., X signal) and the delayed remaining two signals (Y and Z signals) to generate the signal from the accelerometer 113 to be spectrally mixed with the acoustic signals from the microphone array $\mathbf{121}_1$-$\mathbf{121}_M$.

As shown in FIG. 3, the outputs of the spectral mixer 151 and the beamformer 152 are received by a switch 153. The switch 153 selects the output of the spectral mixer 151 when the ambient or environmental noise is greater than a pre-determined threshold or when wind noise is detected. When the switch 153 selects the output of the spectral mixer 151, the output of the switch 153 is the mixed signal. Conversely, the switch 153 outputs the enhanced speech signal from the beamformer 152 when the ambient or environmental noise is lesser than or equal to the pre-determined threshold and when wind noise is not detected.

In FIG. 3, the noise suppressor 140 receives and uses the VAD output to estimate the noise from the vicinity of the user and remove the noise from the signal received from the switch 153 which may be either the mixed signal from the spectral mixer 151 or the enhanced speech signal from the beamformer 152. In one embodiment the noise suppressor may also receive from beamformer 152 the output of a second beam used to capture the noise as depicted in the right part of FIG. 1. The noise suppressor 140 may output a noise suppressed speech output to the speech codec 160. The speech codec 160 may also receive the pitch estimate that is outputted from the pitch detector 131 as well as the VAD output from the VAD 130. The speech codec 160 may correct a pitch component of the noise suppressed speech output from the noise suppressor 150 using the VAD output and the pitch estimate to generate an enhanced speech final output.

Figure 4:
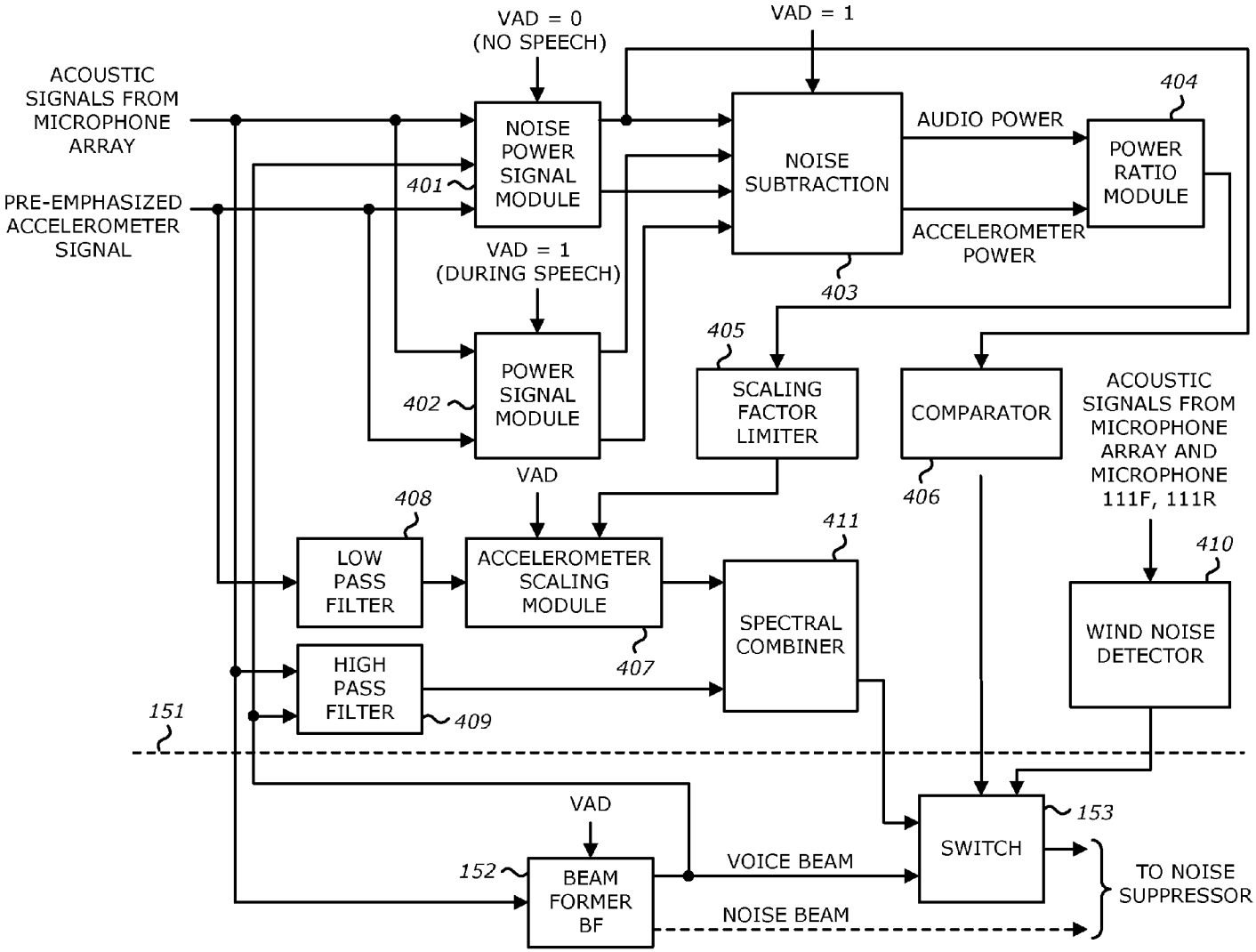
FIG. 4 illustrates a block diagram of components of the system for improving voice quality in a mobile device according to one embodiment of the invention.

FIG. 4 illustrates a block diagram of components of the system for improving voice quality in a mobile device according to one embodiment of the invention. Specifically, FIG. 4 illustrates the details of the spectral mixer 151, the beamformer 152 and the switch 153 in FIG. 3.

In one embodiment, the spectral mixer 151 includes a noise power signal module 401 and a power signal module 402. Both of these modules compute the powers in the low-frequency band of the accelerometer (e.g., below the Fc cutoff frequency in FIG. 5). Both the noise power signal module 401 and the power signal module 402 may receive the VAD output from the VAD 130 as well as acoustic signals from the microphone array $\mathbf{121}_1$-$\mathbf{121}_M$ or beamformer 152 and the accelerometer's 113 output signal. The accelerometer's 113 output signal may be pre-emphasized to account for lip radiation characteristic prior to being received by the noise power signal module 401 and the power signal module 402. When the VAD output indicates that no voice activity is detected, the noise power signal module 401 computes an acoustic noise power signal that is a noise power signal in the acoustic signal from the microphone array $\mathbf{121}_1$-$\mathbf{121}_M$ or beamformer and an accelerometer noise power signal that is a noise power signal in the pre-emphasized accelerometer signal. The noise power module 401 may employ a minimum tracking method for estimating the noise during VAD=0. Alternatively this module can use a 2-channel noise estimator capable of estimating both stationary and non-stationary noises during both VAD=0 and VAD=1. In this case the two 2-channel noise estimator can use as inputs the voice beam and the noise beam outputs of the beamformer 152. When the VAD output indicates that voice activity is detected, the power signal module 402 computes an acoustic power signal that is a power signal during speech in the acoustic signal from the microphone array $\mathbf{121}_1$-$\mathbf{121}_M$ or beamformer and an accelerometer power signal that is a power signal in the pre-emphasized accelerometer signal.

The outputs of the noise power signal module 401 and the power signal module 402 may be used by the noise subtraction module 403 to generate a final acoustic power signal and a final accelerometer power signal. For instance, the noise subtraction module 403 generates the final acoustic power signal by removing the acoustic noise power signal from the acoustic power signal and generates the final accelerometer power signal by removing the accelerometer noise power signal from the accelerometer power signal. The noise subtraction module 403 limits the amount of noise subtraction in such a way that the final acoustic power and the final accelerometer power are always positive when speech is present.

The noise subtraction module 403 included in the spectral mixer 151 may also receive the VAD signal in order to generate a low-frequency final accelerometer power signal and a low-frequency final acoustic power signal that are signals within a same low frequency band during VAD=1 intervals.

In the embodiment in FIG. 4, the spectral mixer 151 may include a power ratio module 404 that is coupled to the noise subtraction module 403 to receive the low-frequency final accelerometer power signal and the low-frequency final acoustic power signal. The power ratio module 404 computes a power ratio between the low-frequency final acoustic power signal and the low-frequency final accelerometer power signal. A scaling factor limiter module 405 that is included in the spectral mixer 151 may then generate a scaling factor by smoothing the power ratio received from the power ratio module 404, limiting the smoothed power ratio to an allowable range (e.g., +/−10 dB or +/−15 dB), and by computing the square root of the smoothed and limited power ratio.

As shown in FIG. 4, spectral mixer 151 includes a low-pass filter 408 and a high-pass filter 409. The low-pass filter 408 applies a cutoff frequency (Fc) to the pre-emphasized accelerometer signal to generate a low-pass filtered pre-emphasized accelerometer signal and the high-pass filter 409 applies the cutoff frequency (Fc) to the acoustic signals from the microphone array $\mathbf{121}_1$-$\mathbf{121}_M$ or from the beamformer to generate a final acoustic signal. In one embodiment, the low-pass filter 408 and the high-pass filter 409 have the same cutoff frequency (e.g., Fc being 1000 Hz). In this embodiment, the resulting signals may be mixed such that the low frequency band (e.g., 1000 Hz and under) of the mixed signal includes one signal (e.g., accelerometer's 113 output signal) and the high frequency band (e.g., over 1000 Hz) of the mixed signal includes the other signal (e.g., acoustic signals received from the microphone array $\mathbf{121}_1$-$\mathbf{121}_M$ or from beamformer). In one embodiment, an accelerometer scaling module 407 receives the low-pass filtered pre-emphasized accelerometer signal from the low-pass filter 408 and scales the low-pass filtered pre-emphasized accelerometer signal using the scaling factor from the scaling factor limiter module 405 to generate a final accelerometer signal during the time when VAD=1. When VAD=0 the accelerometer scaling module 407 may apply a certain fixed attenuation to the pre-emphasized accelerometer signal (e.g., between 0 dB and 10 dB attenuation).

Figure 5:
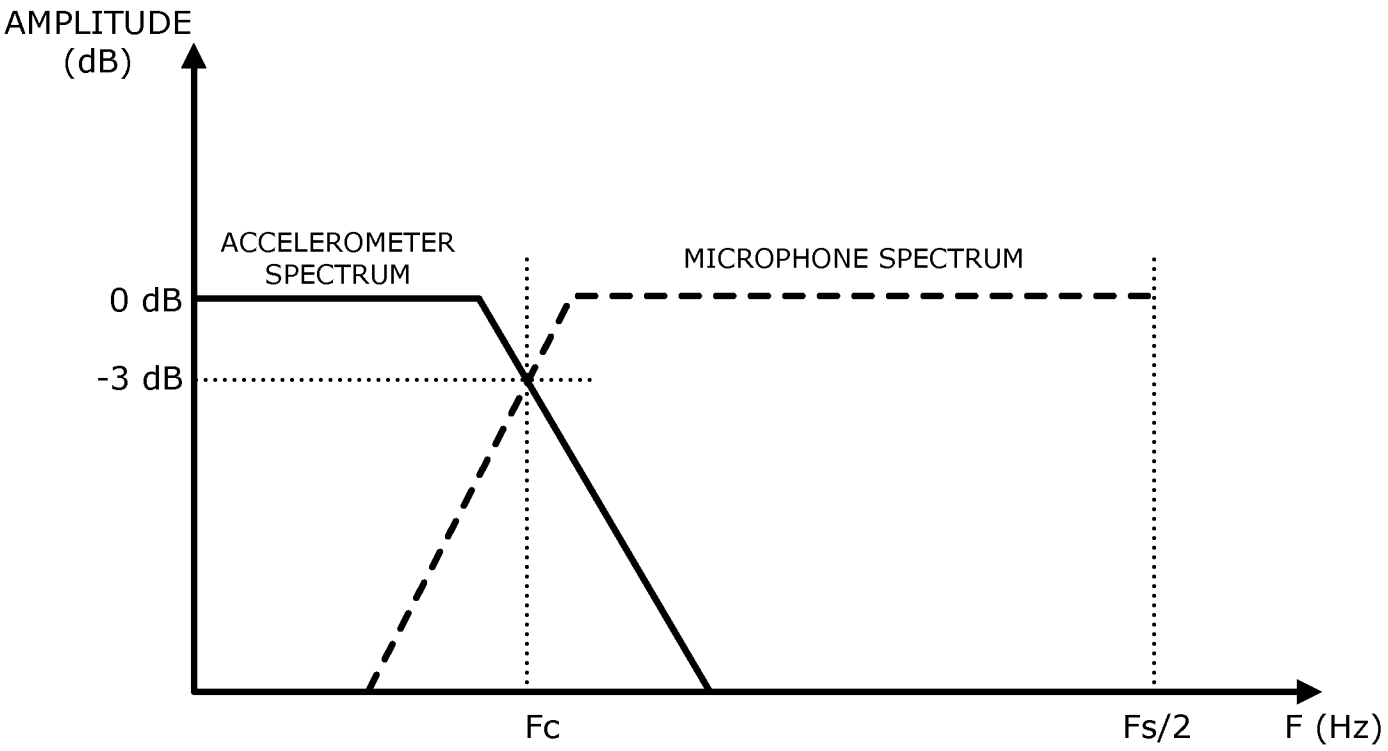
FIG. 5 illustrates an exemplary graph of the signals from an accelerometer and from the microphones in the headset on which spectral mixing is performed according to one embodiment of the invention.
Figure 6:
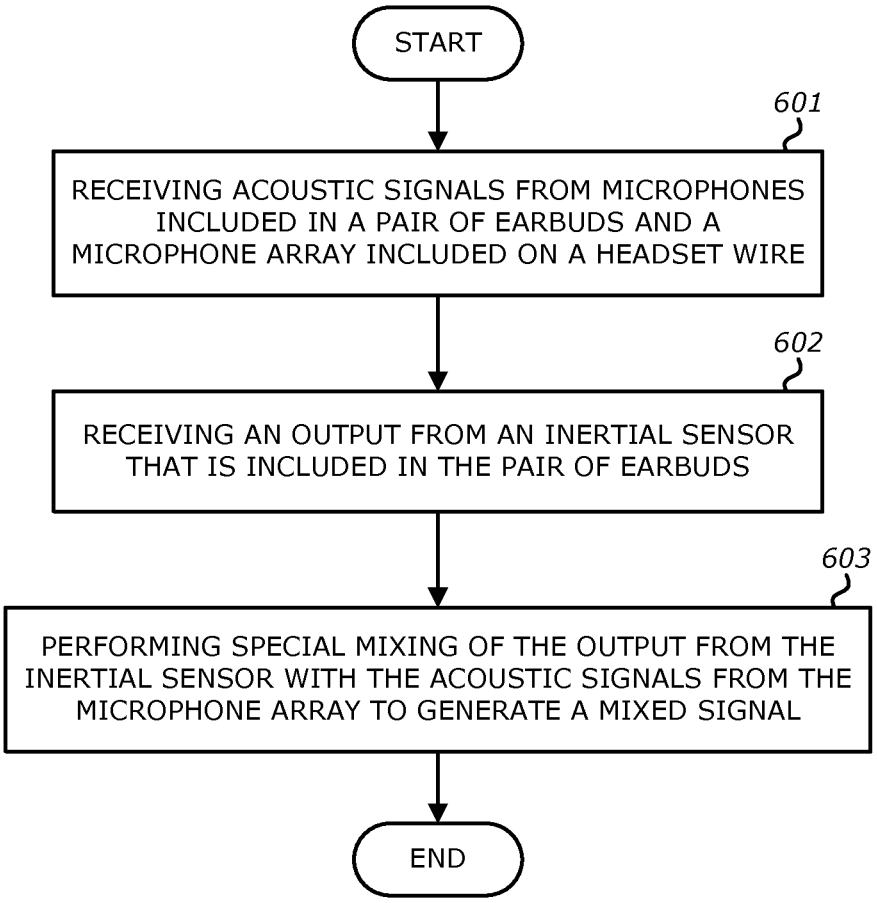
FIG. 6 illustrates a flow diagram of an example method of improving voice quality in a mobile device according to one embodiment of the invention.

In the embodiment in FIG. 4, a spectral combiner 411 is coupled to the accelerometer scaling module 407 and the high-pass filter 409 to receive the final accelerometer signal and the final acoustic signal from the microphone array $\mathbf{121}_1$-$\mathbf{121}_M$ or beamformer, respectively, and combines/sums the two signals. The combination can be performed either in the time domain or in the frequency domain. Referring to FIG. 6, an exemplary graph of the signals from the accelerometer 113 and from the microphones array $\mathbf{121}_1$-$\mathbf{121}_M$ or beamformer 152 in the headset on which spectral mixing is performed according to one embodiment of the invention is illustrated. As shown in FIG. 5, the spectral combiner 411 performs spectral summation of the final accelerometer signal and the final acoustic signal to generate the mixed signal that includes the final accelerometer signal in the low frequency band (e.g., 1000 Hz and under) and the final acoustic signal in the high frequency band (e.g., over 1000 Hz).

In one embodiment, the spectral mixer 151 also includes a comparator 406 and a wind noise detector 410. In other embodiments, the comparator 406 and the wind noise detector 410 are separate from the spectral mixer 151. The comparator 406 receives the acoustic noise power signal from the noise power signal module 401 and compares the acoustic noise power signal to a pre-determined threshold. The wind noise detector 410 may receive the acoustic signal from the microphone array $\mathbf{121}_1$-$\mathbf{121}_M$ and from the microphones $\mathbf{111}_F$, $\mathbf{111}_R$ included in a pair of earbuds 110 and may determine whether wind noise is detected in at least two of the microphones (e.g., from the microphone array $\mathbf{121}_1$-$\mathbf{121}_M$ and the microphones $\mathbf{111}_F$, $\mathbf{111}_R$). In some embodiments, wind noise is detected in at least two of the microphones when the cross-correlation between two of the microphones is below a pre-determined threshold. The outputs of the comparator 406 and the wind noise detector 410 are coupled to the switch 153. As shown in FIG. 4, the switch 153 may also receive (i) the mixed signal from the spectral combiner 411 and (ii) a voice beam signal from the beamformer 152. In one embodiment, the switch 153 outputs the mixed signal when the comparator 406 determines that the acoustic noise power signal is greater than the pre-determined threshold or when the wind noise detector 410 detects wind noise in at least two of the microphones $\mathbf{111}_F$, $\mathbf{111}_R$ included in the pair of earbuds and the microphone array $\mathbf{121}_1$-$\mathbf{121}_M$. In this embodiment, the mixed signal is selected by the switch 153 because it is more robust to low-frequency noises from the user's environment (e.g., wind noise, environmental noise, car noise, etc.). In this embodiment, the switch 153 outputs the voice beam signal from the beamformer when the comparator 406 determines that the acoustic noise power signal is lesser than or equal to the pre-determined threshold and when the wind noise detector 410 determines that wind noise is not detected in at least two of the microphones.

FIG. 6 illustrates a flow diagram of an example method of improving voice quality in a mobile device according to one embodiment of the invention. Method 600 starts with a mobile device receiving acoustic signals from microphones included in a pair of earbuds and the microphone array included on a headset wire (Block 601). The mobile device then receives an output from an inertial sensor that is included in the pair of earbuds and detects vibration of the user's vocal chords based on vibrations in bones and tissue of the user's head (Block 602). At Block 603, a spectral mixer 151 included in the mobile device performs spectral mixing of the output from the inertial sensor with the acoustic signals from the microphone array to generate a mixed signal. In one embodiment, performing spectral mixing includes scaling the output from the inertial sensor by a scaling factor based on a power ratio between the acoustic signals from the microphone array and the output from the inertial sensor. This allows the power level of the output from the inertial sensor to be matched with the power level of the acoustic signals. In this embodiment, when the VAD output indicates that no voice activity is detected, an acoustic noise power signal and an accelerometer noise power signal are computed and when the VAD output indicates that voice activity is detected, an acoustic power signal and an accelerometer power signal are computed. The spectral mixer 151 may generate (i) a final acoustic power signal by removing the acoustic noise power signal from the acoustic power signal and (ii) a final accelerometer power signal by removing the accelerometer noise power signal from the accelerometer power signal. The spectral mixer 151 may then limit the amount of noise power subtracted in order to generate a low-frequency final accelerometer power signal and a low-frequency final acoustic power signal and may compute a power ratio between the low-frequency final acoustic power signal and the low-frequency final accelerometer power signal. In this embodiment, a scaling factor is computed by smoothing the power ratio, limiting the power ratio to an allowable range, and then computing the square root of the smoothed and limited power ratio. The resulting scaling factor is used to scale the signal from the accelerometer. The resulting signal from the accelerometer may thus be scaled to match the level of the output of the acoustic signals. In another embodiment the limited scaling factor can be split in two components to scale both the accelerometer and the audio signal. For example if the original scaling factor corresponds to +8 dB for the accelerometer then a 4 dB scaling can be applied to the accelerometer and a −4 dB scaling can be applied to the audio signal. In another embodiment the scaling factor can be computed from the power ratio between the accelerometer signal and the audio signal and be applied to the audio signal. In one embodiment, a pitch detector generates a pitch estimate based on the output from the accelerometer that is received. In this embodiment, the pitch estimate is obtained by (i) using an X, Y, or Z signal generated by the accelerometer that has a highest power level or (ii) using a combination of the X, Y, and Z signals generated by the accelerometer.

Figure 7:
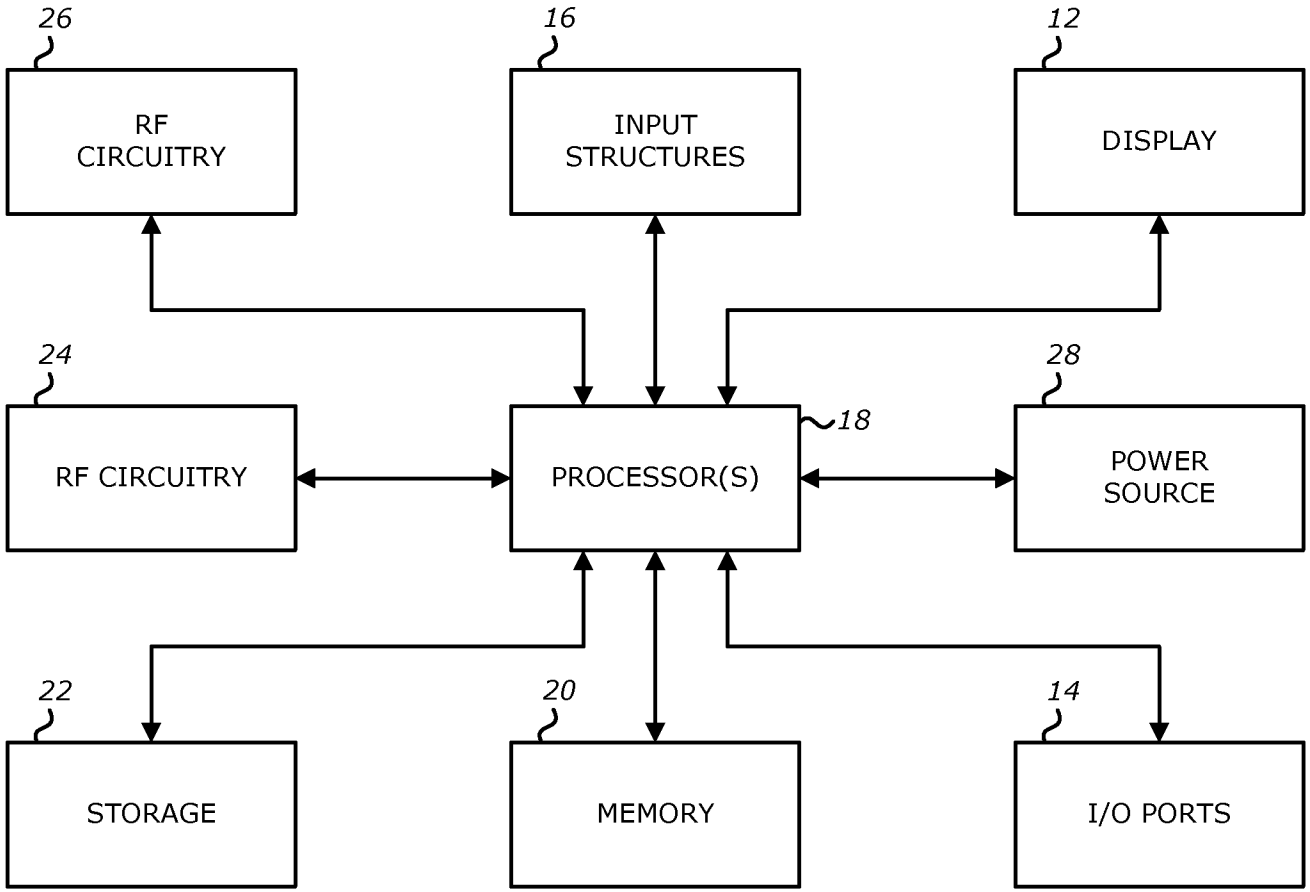
FIG. 7 is a block diagram of exemplary components of an electronic device detecting a user's voice activity in accordance with aspects of the present disclosure.
Figure 8:
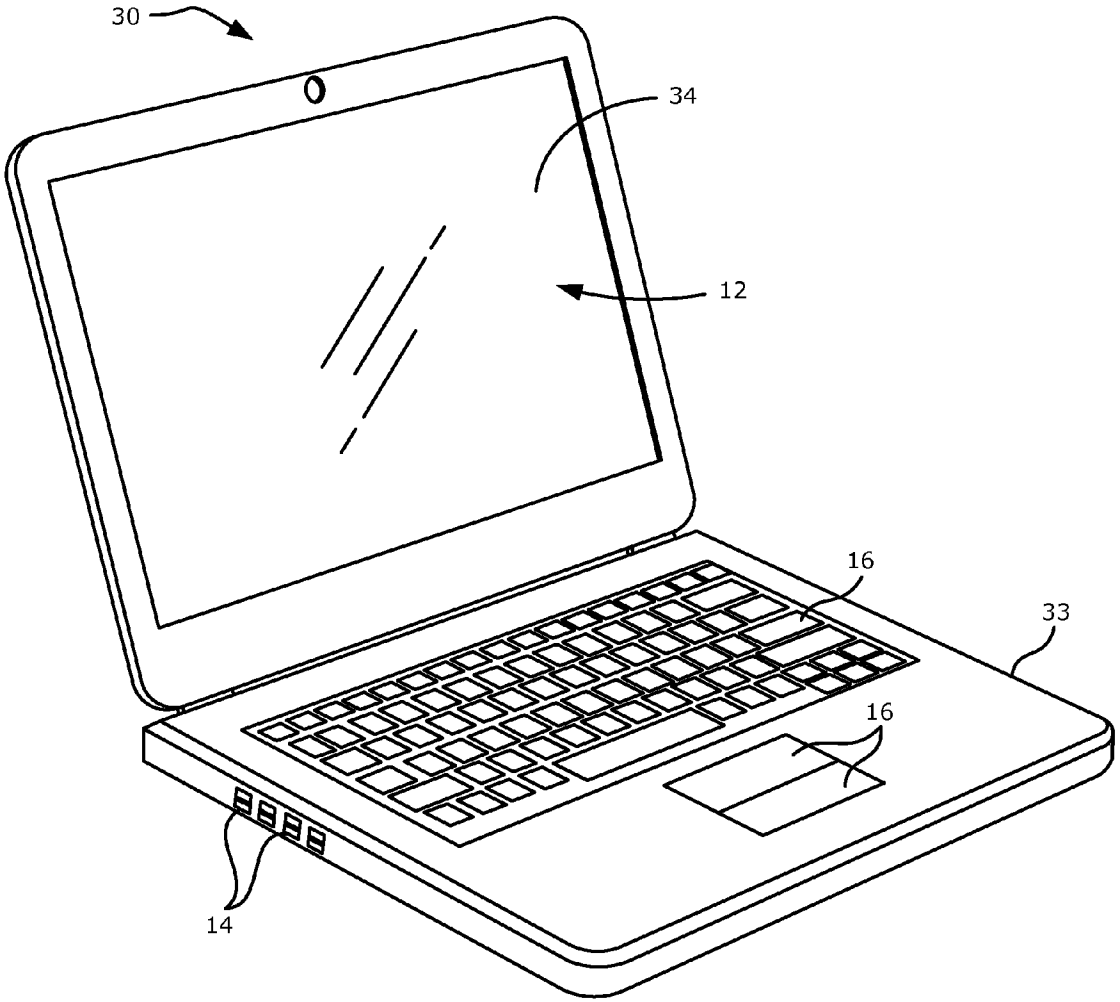
FIG. 8 is a perspective view of an electronic device in the form of a computer, in accordance with aspects of the present disclosure.
Figure 9:
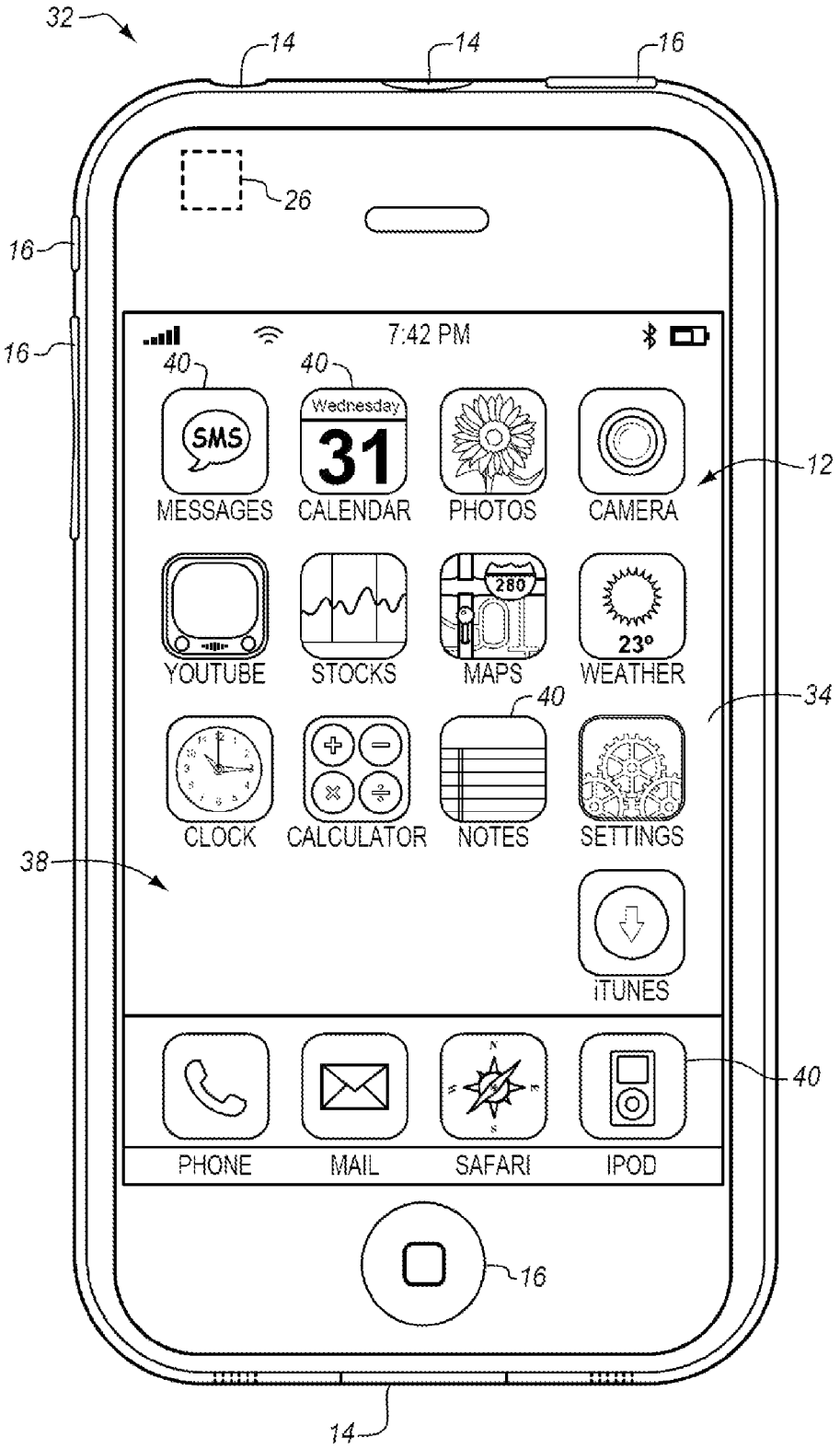
FIG. 9 is a front-view of a portable handheld electronic device, in accordance with aspects of the present disclosure.
Figure 10:
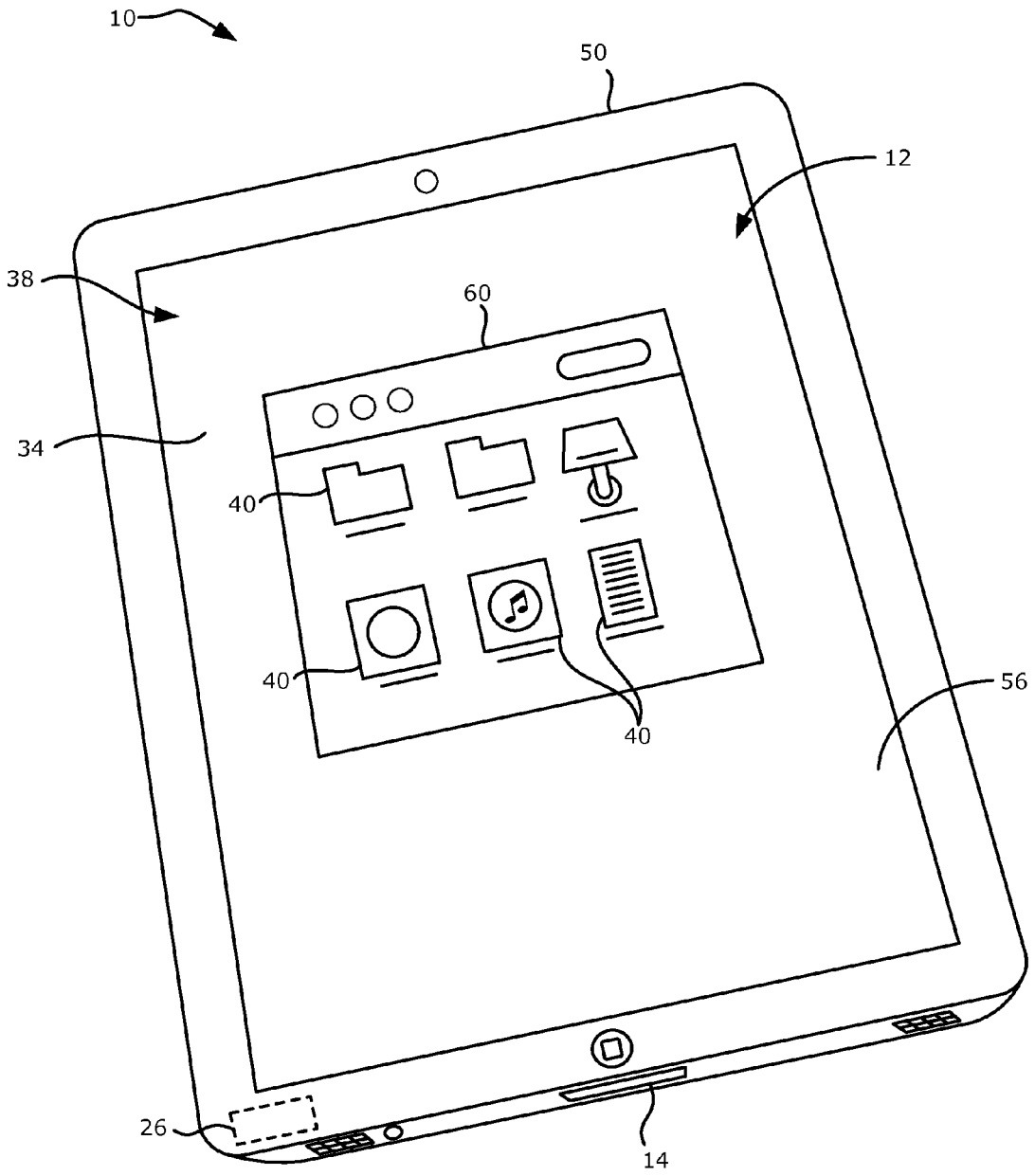
FIG. 10 is a perspective view of a tablet-style electronic device that may be used in conjunction with aspects of the present disclosure.

A general description of suitable electronic devices for performing these functions is provided below with respect to FIGS. 7-10. Specifically, FIG. 7 is a block diagram depicting various components that may be present in electronic devices suitable for use with the present techniques. FIG. 8 depicts an example of a suitable electronic device in the form of a computer. FIG. 9 depicts another example of a suitable electronic device in the form of a handheld portable electronic device. Additionally, FIG. 10 depicts yet another example of a suitable electronic device in the form of a computing device having a tablet-style form factor. These types of electronic devices, as well as other electronic devices providing comparable voice communications capabilities (e.g., VoIP, telephone communications, etc.), may be used in conjunction with the present techniques.

Keeping the above points in mind, FIG. 7 is a block diagram illustrating components that may be present in one such electronic device 10, and which may allow the device 10 to function in accordance with the techniques discussed herein. The various functional blocks shown in FIG. 7 may include hardware elements (including circuitry), software elements (including computer code stored on a computer-readable medium, such as a hard drive or system memory), or a combination of both hardware and software elements. It should be noted that FIG. 7 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

FIG. 8 illustrates an embodiment of the electronic device 10 in the form of a computer 30. The computer 30 may include computers that are generally portable (such as laptop, notebook, tablet, and handheld computers), as well as computers that are generally used in one place (such as conventional desktop computers, workstations, and servers). In certain embodiments, the electronic device 10 in the form of a computer may be a model of a MacBook™, MacBook™ Pro, MacBook Air™, iMac™, Mac™ Mini, or Mac Pro™, available from Apple Inc. of Cupertino, Calif. The depicted computer 30 includes a housing or enclosure 33, the display 12 (e.g., as an LCD 34 or some other suitable display), I/O ports 14, and input structures 16.

The electronic device 10 may also take the form of other types of devices, such as mobile telephones, media players, personal data organizers, handheld game platforms, cameras, and/or combinations of such devices. For instance, as generally depicted in FIG. 9, the device 10 may be provided in the form of a handheld electronic device 32 that includes various functionalities (such as the ability to take pictures, make telephone calls, access the Internet, communicate via email, record audio and/or video, listen to music, play games, connect to wireless networks, and so forth). By way of example, the handheld device 32 may be a model of an iPod™, iPod™ Touch, or iPhone™ available from Apple Inc.

In another embodiment, the electronic device 10 may also be provided in the form of a portable multi-function tablet computing device 50, as depicted in FIG. 10. In certain embodiments, the tablet computing device 50 may provide the functionality of media player, a web browser, a cellular phone, a gaming platform, a personal data organizer, and so forth. By way of example, the tablet computing device 50 may be a model of an iPad™ tablet computer, available from Apple Inc.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

The invention claimed is:

1. A method of improving voice quality in a mobile device comprising:

receiving acoustic signals from one or more microphones included with a pair of earbuds, wherein a headset includes the pair of earbuds and a headset wire;

receiving an output from an inertial sensor that is included in the pair of earbuds;

performing spectral mixing of the output from the inertial sensor with the acoustic signals from the one or more microphones to generate a mixed signal, wherein performing spectral mixing includes scaling the output from the inertial sensor by a scaling factor based on a power ratio between the acoustic signals from the one or more microphones and the output from the inertial sensor.

2. The method of claim 1, wherein the one or more microphones included with the pair of earbuds comprises: a front microphone and a rear microphone in each of the earbuds.

3. The method of claim 1, wherein the inertial sensor is an accelerometer that is included in each of the earbuds.

4. The method of claim 3, performing spectral mixing to generate the mixed signal further comprises:

pre-emphasizing the output from the accelerometer to account for lip radiation characteristic to generate a pre-emphasized accelerometer signal.

5. The method of claim 4, performing spectral mixing to generate the mixed signal further comprises:

receiving from a voice activity detector (VAD) a VAD output that is based on (i) the acoustic signals from the one or more microphones and (ii) the data output by the accelerometer;

when the VAD output indicates that no voice activity is detected, computing an acoustic noise power signal and an accelerometer noise power signal, wherein the acoustic noise power signal is a noise power signal in the acoustic signal from the one or more microphones and the accelerometer noise power signal is a noise power signal in the pre-emphasized accelerometer signal;

when an alternative non-stationary noise detector is employed it estimates the noise power in the acoustic signal and the accelerometer signal during intervals with either voice activity or no voice activity;

when the VAD output indicates that voice activity is detected, computing an acoustic power signal and an accelerometer power signal, wherein the acoustic power signal is a power signal during speech in the acoustic signal from the one or more microphones and the accelerometer power signal is a power signal during speech in the pre-emphasized accelerometer signal; and generating (i) a final acoustic power signal by removing the acoustic noise power signal from the acoustic power signal and (ii) a final accelerometer power signal by removing the accelerometer noise power signal from the accelerometer power signal.

6. The method of claim 5, wherein performing spectral mixing to generate the mixed signal further comprises:

applying limits to the noise powers subtracted by the noise subtraction module in order to generate a positive low-frequency final accelerometer power signal and a positive low-frequency final acoustic power signal;

computing the power ratio between the low-frequency final accelerometer power signal and the low-frequency final acoustic power signal, wherein the low-frequency final accelerometer power signal and the low-frequency final acoustic power signal are within a same low frequency band; and computing the scaling factor by smoothing the power ratio, limiting it to an allowable range, and by extracting the square root from the smoothed and limited power ratio.

7. The method of claim 6, wherein performing spectral mixing to generate the mixed signal further comprises:

applying a low-pass filter with a cutoff frequency (Fc) to the pre-emphasized accelerometer signal to generate a low-pass filtered pre-emphasized accelerometer signal; and scaling the low-pass filtered pre-emphasized accelerometer signal using the scaling factor to generate a final accelerometer signal during the time when voice activity is detected (VAD=1); and applying a certain fixed attenuation to the low-pass filtered pre-emphasized accelerometer signal when voice activity is not detected (VAD=0).

8. The method of claim 7, wherein performing spectral mixing to generate the mixed signal further comprises:

applying a high-pass filter with the cutoff frequency (Fc) to the acoustic signals from the one or more microphones to generate a final acoustic signal from the one or more microphones; and mixing the scaled accelerometer signal with the final acoustic signal from the one or more microphones to generate the mixed signal.

9. The method of claim 8, further comprising:

calculating a delay between the final acoustic signal and the scaled accelerometer signal based on cross-correlation; and applying the delay to the scaled accelerometer signal before mixing the scaled accelerometer signal with the final acoustic signal to generate the mixed signal.

10. The method of claim 9, further comprising:

receiving by a switch (i) the mixed signal and (ii) a speech signal from a beamformer, wherein the acoustic signals from the one or more microphones are received by the beamformer;

outputting by the switch the mixed signal when the acoustic noise power signal is greater than a noise threshold or when wind noise is detected by the one or more microphones; and outputting by the switch the speech signal from the beamformer when the acoustic noise power signal is lesser than or equal to the noise threshold and when wind noise is not detected by the one or more microphones.

11. The method of claim 10, further comprising:

receiving by a noise suppressor (i) the output from the switch, (ii) the VAD output and (iii) a noise beam output from the beamformer; and suppressing by the noise suppressor noise included in the output from the switch based on the VAD output and using a noise estimate from the noise beam output.

12. The method of claim 11, further comprising:

generating pitch estimate by a pitch detector based on autocorrelation method and using the output from the accelerometer, wherein the pitch estimate is obtained by (i) using an X, Y, or Z signal generated by the accelerometer that has a highest power level or (ii) using a combination of the X, Y, and Z signals generated by the accelerometer.

13. The method of claim 3, wherein receiving the output from the accelerometer further comprises:

receiving an output signal for each of the three axes of the accelerometer, wherein the output signal for each of the three axes are X, Y, and Z signals generated by the accelerometer, respectively;

determining a total power in each of the X, Y, and Z signals generated by the accelerometer, respectively; and selecting the X, Y, or Z signal having the highest power as the output from the accelerometer.

14. The method of claim 3, wherein receiving the output from the accelerometer further comprises:

receiving an output signal for each of the three axes of the accelerometer, wherein the output signal for each of the three axes are X, Y, and Z signals generated by the accelerometer, respectively; and computing an average of the X, Y, and Z signals to generate the output from the accelerometer.

15. The method of claim 3, wherein receiving the output from the accelerometer further comprises:

receiving an output signal for each of the three axes of the accelerometer, wherein the output signal for each of the three axes are X, Y, and Z signals generated by the accelerometer, respectively;

computing using cross-correlation a delay between the X and Y signals, a delay between the X and Z signals, and a delay between the Y and Z signals;

determining a most advanced signal from the X, Y, and Z signals based on the computed delays;

delaying a remaining two signals from the X, Y, and Z signals, the remaining two signals not including the most advanced signal; and computing an average of the most advanced signal and the delayed remaining two signals to obtain the output of the accelerometer.

16. A system for improving voice quality in a mobile device comprising:

a headset including a pair of earbuds and a headset wire, wherein at least one of the earbuds includes an accelerometer, wherein the headset includes one or more microphones; and a spectral mixer coupled to the headset to perform spectral mixing of the output from the accelerometer with acoustic signals from the one or more microphones to generate a mixed signal, wherein performing spectral mixing includes scaling the output from the accelerometer by a scaling factor based on a power ratio between the acoustic signals from the one or more microphones and the output from the accelerometer.

17. The system of claim 16, wherein the one or more microphones comprises a front microphone and a rear microphone in each of the earbuds.

18. The system of claim 16, wherein the spectral mixer pre-emphasizes the output from the accelerometer to account for lip radiation characteristic to generate a pre-emphasized accelerometer signal.

19. The system of claim 18, further comprising:

a voice activity detector (VAD) coupled to the headset, the VAD to generate a VAD output based on (i) acoustic signals received from the one or more microphones and (ii) data output by the accelerometer, wherein when the VAD output indicates that no voice activity is detected, the spectral mixer computes an acoustic noise power signal and an accelerometer noise power signal, wherein the acoustic noise power signal is a noise power signal in the acoustic signal from the one or more microphones and the accelerometer noise power signal is a noise power signal in the pre-emphasized accelerometer signal;

when an alternative non-stationary noise detector is employed it estimates the noise power in the acoustic signal and the accelerometer signal during intervals with either voice activity or no voice activity;

when the VAD output indicates that voice activity is detected, the spectral mixer computes an acoustic power signal and an accelerometer power signal, wherein the acoustic power signal is a power signal during speech in the acoustic signal from the or more microphones and the accelerometer power signal is a power signal during speech in the pre-emphasized accelerometer signal; and the spectral mixer generates (i) a final acoustic power signal by removing the acoustic noise power signal from the acoustic power signal and (ii) a final accelerometer power signal by removing the accelerometer noise power signal from the accelerometer power signal.

20. The system of claim 19, wherein the spectral mixer further:

applies limits to the noise removed in order to generate a positive low-frequency final accelerometer power signal and a positive low-frequency final acoustic power signal;

computes the power ratio between the low-frequency final acoustic power signal and the low-frequency final accelerometer power signal, wherein the low-frequency final accelerometer power signal and the low-frequency final acoustic power signal are within a same low frequency band; and computes the scaling factor by smoothing the power ratio, limiting the power ratio to an allowable range, and by computing the square root of the smoothed and limited power ratio.

21. The system of claim 20, wherein the spectral mixer further:

applies a low-pass filter with a cutoff frequency (Fc) to the pre-emphasized accelerometer signal to generate a low-pass filtered pre-emphasized accelerometer signal; and scales the low-pass filtered pre-emphasized accelerometer signal using the scaling factor to generate a final accelerometer signal when voice activity is detected (VAD=1); and applies a certain fixed attenuation to the low-pass filtered pre-emphasized accelerometer signal with when voice activity is not detected (VAD=0).

22. The system of claim 21, wherein the spectral mixer further:

applies a high-pass filter with the cutoff frequency (Fc) to the acoustic signals from the one or more microphones to generate a final acoustic signal from the one or more microphones; and mixes the final accelerometer signal with the final acoustic signal from the one or more microphones to generate the mixed signal.

23. The system of claim 22, wherein the spectral mixer further:

calculates a delay between the final accelerometer signal and the final acoustic signal based on cross-correlation; and applies the delay to the final accelerometer signal before mixing with the final acoustic signal to generate the mixed signal.

24. The system of claim 23, further comprising:

a beamformer to receive the acoustic signals from the one or more microphones and generate an enhanced acoustic signal; and a switch to receive (i) the mixed signal from the spectral mixer and (ii) a speech signal from the beamformer, and to output the mixed signal when the acoustic noise power signal is greater than a threshold or when wind noise is detected by the one or more microphones, and to output the speech signal from the beamformer when the acoustic noise power signal is lesser than or equal to a threshold and when wind noise is not detected.

25. The system of claim 24, further comprising:

a noise suppressor coupled to the switch and the VAD, the noise suppressor to suppress noise from the output from the switch based on the VAD output and a noise estimate and to output a noise suppressed speech output.

26. The system of claim 25, further comprising:

a pitch detector to generate a pitch estimate based on the output from the accelerometer, wherein the pitch detector generates the pitch estimate based on autocorrelation method by (i) using an X, Y, or Z signal generated by the accelerometer that has a highest power level or (ii) using a combination of the X, Y, and Z signals generated by the accelerometer.

27. The system of claim 26, further comprising:

a speech codec coupled to the noise suppressor, the VAD, and the pitch detector, the speech codec to employ an enhanced pitch and an enhanced VAD, both computed based on the accelerometer signal.

28. The system of claim 21, wherein the spectral mixer further:

receives an enhanced acoustic signal from a beamformer that receives acoustic signals from the one or more microphones and an output from the VAD;

applies a high-pass filter with the cutoff frequency (Fc) to the enhanced acoustic signal from the beamformer to generate a final acoustic signal from the beamformer; and mixes the final scaled accelerometer signal with the final acoustic signal from the beamformer to generate the mixed signal.

* * * * *